United States Patent [19]

Bürger

[11] Patent Number: 4,921,406

[45] Date of Patent: May 1, 1990

[54] MECHANICAL PRIMARY VACUUM PUMP INCLUDING A SPRING-LOADED NON-RETURN FLAP VALVE

[75] Inventor: Heinz-Dieter Bürger, Wertheim, Fed. Rep. of Germany

[73] Assignee: Alcatel Hochvakuumtechnik GmbH, Wertheim, Fed. Rep. of Germany

[21] Appl. No.: 293,775

[22] Filed: Jan. 4, 1989

[51] Int. Cl.[5] ..... F04B 41/06

[52] U.S. Cl. ..... 417/87; 417/432

[58] Field of Search ..... 417/87, 432, 559, 199.1, 417/205, 199.2, 54; 418/3

[56] References Cited

U.S. PATENT DOCUMENTS 3,556,681 1/1971 Jennings ..... 417/87
4,770,609 9/1988 Uchida et al. ..... 418/3

FOREIGN PATENT DOCUMENTS 1270215 6/1968 Fed. Rep. of Germany .
1678604 3/1972 Fed. Rep. of Germany .
2426171 12/1979 France .

*Primary Examiner*—Leonard E. Smith
*Assistant Examiner*—Douglas J. Makosy
*Attorney, Agent, or Firm*—Sughrue, Mion, Zinn, Macpeak & Seas

[57] ABSTRACT

The invention relates to a mechanical vacuum pump having a displacement member (2) and a casing (1) which is provided with an inlet channel (3) on the suction side and an outlet channel (4) on the discharge side. A spring-loaded non-return flap valve (5) is incorporated into the outlet channel (4). Upstream of this flap (5), a gas jet pump (7, 8) is installed in the outlet channel (4), the jet direction being parallel to the sealing surface of the non-return flap valve (5).

This gas jet pump allows to significantly increase the final vacuum of the mechanical vacuum pump and to improve the cooling of the pump.

2 Claims, 1 Drawing Sheet

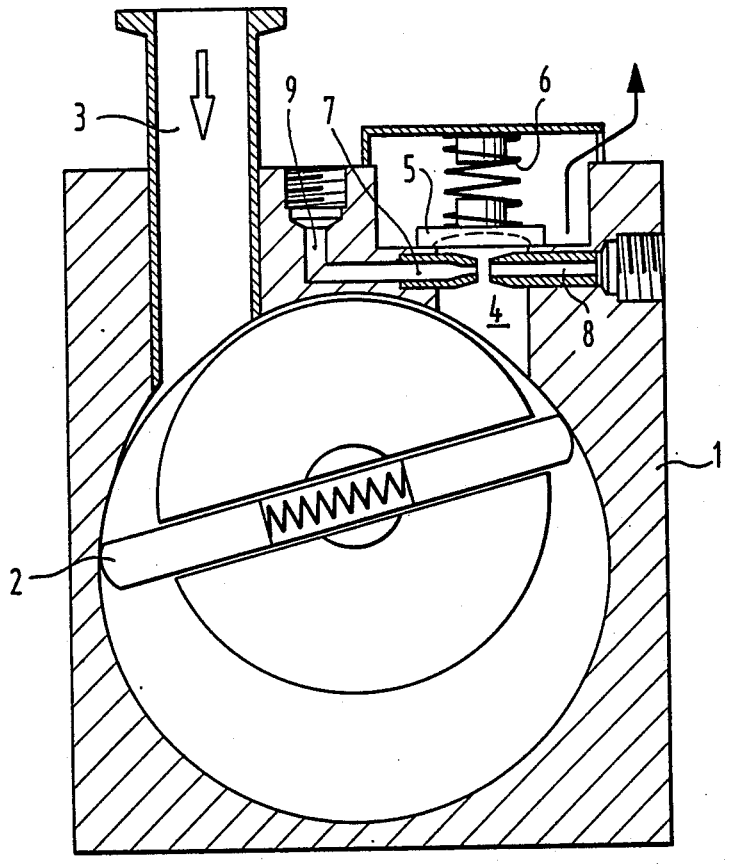
3
9
7
6
5
4
8
1
2

MECHANICAL PRIMARY VACUUM PUMP INCLUDING A SPRING-LOADED NON-RETURN FLAP VALVE

FIELD OF THE INVENTION

The invention relates to a mechanical primary vacuum pump including a casing which comprises an inlet channel on the suction side and an outlet channel on the discharge side, a displacement member rotating in the casing, and a spring-loaded non-return flap valve associated to the outlet channel.

BACKGROUND OF THE INVENTION

Mechanical primary vacuum pumps include a motor-driven displacement member such as a to-and-fro moving piston, one or more rotary pistons, a rotary flap or a sliding flap. A spring-loaded non-return flap valve is often provided in such a pump, at least in the outlet channel, in order to maintain the achieved vacuum pressure after the shut-off of the pump in a tank which has been evacuated. Mechanical primary pumps are often combined with pumps of other types, such as diffusion or molecular pumps, in order to reach a higher vacuum, the mechanical pump then acting as primary pump and operating against ambient pressure. In some cases, a jet pump such as a water ring pump has been inserted into the outlet channel of the mechanical vacuum pump, which signifies that the mechanical pump no more operates against ambient pressure, but against a significantly lower pressure, which allows to increase the quality of the final vacuum to be achieved by the mechanical pump.

French patent application No. 24 26 171 discloses a mechanical vacuum pump which is combined with a jet pump. The latter, however, is only operative when the mechanical vacuum pump is not operative. The German patent document DE-12 70 215 B and the German patent document DE-16 78 604 A disclose vacuum pumping devices including a mechanical primary pump and a jet pump connected in series, the latter being located between the tank to be evacuated and the mechanical primary pump and operating as secondary pump.

SUMMARY OF THE INVENTION

The object of the invention is to improve a mechanical vacuum pump in order to obtain a higher final vacuum. Another object is to improve the cooling of the pump for a given power input. This would allow to apply the invention to rotating flap pumps which are not lubricated, as in this case, the temperature increase of the casing of the pump poses serious problems.

These objects are achieved according to the invention by a mechanical primary vacuum pump including a casing which comprises an inlet channel on the suction side and an outlet channel on the discharge side, a displacement member rotating in the casing, a spring-loaded non-return flap valve associated to the outlet channel, and a gas jet pump incorporated in said outlet channel upstream of the flap valve.

Preferably, the direction of the jet of this gas jet pump is parallel to the sealing surface of the non-return flap valve.

As long as the non-return flap valve is repeatedly opened and closed during the first period of a pumping operation, the gas jet pump practically only serves as a cooling means for the discharge space of the pump to which the outlet channel belongs. With decreasing mass current, the non-return flap valve closes the outlet channel and the remaining molecules are conveyed and discharged by the jet of the gas jet pump.

BRIEF DESCRIPTION OF THE DRAWING

The FIGURE shows a sectional view of mechanical vacuum pump forming a preferred embodiment of the invention.

DETAILED DESCRIPTION OF THE INVENTION

The invention will now be described in more detail by means of the unique drawing which shows schematically a cut view through a vacuum pump according to the invention.

The preferred embodiment concerns a rotary vane pump comprising a casing 1 and a rotating displacement member 2. The casing is located in an oil tank (not shown) and is provided with an inlet channel 3, which may be connected to a tank to be evacuated, and an outlet channel 4, which can be connected to the ambient atmosphere via a non-return flap valve 5. The non-return flap valve 5 is urged by a spring 6 into the sealing position as long as the pressure in the outlet channel 4 does not exceed the counter-pressure produced by the atmospheric pressure and the load of the spring 6.

Upstream of the non-return flap valve 5, a gas jet pump is disposed in the outlet channel 4, the direction of the jet of this pump being parallel to the sealing surface of the flap valve 5. The jet pump consists of an injection nozzle 7 and of a reception tube 8 in alignment with the nozzle. The nozzle 7 may be connected, through a duct 9 drilled into the wall of the casing 1, to a source (not shown) of pressurized air, while the reception tube 8 either opens into the ambient atmosphere or, as is generally the case, is connected to an air reprocessing recipient in which the gases withdrawn from the tank to be evacuated are isolated from the air, as these gases might be toxic. Of course, instead of air, another driving fluid might be used, especially an inert gas.

The pump in accordance with the invention is not comparable with the above cited known series arrangement of a mechanical primary pump and a gas jet pump, as in such arrangement, the jet pump would be arranged downstream of the non-return flap valve 5 and all the molecules conveyed by the mechanical pump would also be conveyed by the gas jet pump. Due to the integration of the gas jet pump into the mechanical primary pump upstream of the flap valve of this pump, the suction efficiency of the mechanical vacuum pump is fully operative at low pressure difference between the inlet and outlet channels, while the vacuum in the outlet channel 4 upstream of the non-return flap valve 5 becomes significantly lower than atmospheric pressure when the vacuum increases on the suction side of the vane pump. This allows to increase the final vacuum at the inlet channel 3 by at least a factor 10.

The invention is not restricted in detail to the above described preferred embodiment. Thus, the gas jet pump can be equally applied to a mechanical vacuum pump of another type such as a Roots pump or a sliding vane pump. The invention is further applicable not only to non-lubricated, but also to lubricated mechanical vacuum pumps, as even in these cases, the gas jet pump ensures a higher final vacuum and reduces the increase of temperature in the pump.

I claim:

1. A mechanical primary vacuum pump including a casing which comprises an inlet channel on the suction side and an outlet channel on the discharge side, a displacement member rotating in the casing, a spring-loaded non-return flap valve associated to the outlet channel, and a gas jet pump incorporated in said outlet channel upstream of the flap valve.

2. A primary vacuum pump according to claim 1, wherein the direction of the jet of the gas jet pump is parallel to the sealing surface of the flap valve.

* * * * *